United States Patent [19]

Parlant et al.

[11] Patent Number: 4,628,401

[45] Date of Patent: Dec. 9, 1986

[54] ELECTRIC FEED DEVICE WHICH CAN BE STARTED BY A LIQUID

[75] Inventors: James B. Parlant, Touvre; Michel Etourneau, Ruelle; Christian C. Bled, Equeurdreville, all of France

[73] Assignee: Etat Francais, Paris, France

[21] Appl. No.: 673,513

[22] Filed: Nov. 20, 1984

[30] Foreign Application Priority Data

Nov. 22, 1983 [FR] France ..... 83 18538

[51] Int. Cl.[4] ..... H01H 47/22

[52] U.S. Cl. ..... 361/178; 441/17

[58] Field of Search ..... 361/178; 307/69, 118, 307/77, 78, 86; 137/78.3, 392; 441/6, 7, 11, 13, 16, 17

[56] References Cited

U.S. PATENT DOCUMENTS 2,617,972 11/1952 Nutter ..... 361/178

3,595,281 7/1971 Laub ..... 137/392

*Primary Examiner*—L. T. Hix

*Assistant Examiner*—David M. Gray

*Attorney, Agent, or Firm*—Parkhurst & Oliff

[57] ABSTRACT

The invention pertains to an electric device which can be started by immersion in a liquid by way of two electrodes. It includes a first circuit having two electrodes in series with a first voltage source and the coil of a first relay, for controlling a second circuit having in series a second voltage source, a second relay and the contact of the first relay. The second circuit also is connected to use terminals for an external load, the voltage at the use terminals of the circuit being equal to the sum of the voltages from the first and second voltage sources. The device can be applied to power submersible buoys and to detect the presence of a liquid.

10 Claims, 3 Drawing Figures

ELECTRIC FEED DEVICE WHICH CAN BE STARTED BY A LIQUID

BACKGROUND OF THE INVENTION

The technical field of this invention concerns electric feed devices which can be started by immersion in a liquid.

Many electric devices can be started by immersion in a liquid that use either a battery which is directly started by the liquid, or a pressure sensitive switch. In the first instance, a battery is used which is electrolytic to sea water, so that it only produces a current when it is submerged. However, even during storage, this kind of battery can display undesirable discharge features for firing a detonator, for instance, and they are mainly comprised of silver, which increases the cost of such devices. Furthermore, we cannot envisage defusing such a battery. In the other instance, switches, described for instance in French Pat. No. 2 008 865, are used which include a capillary tube in the bottom of which two electrodes are placed. Contact between those two electrodes is achieved at a particular immersion depth, enabling passage of a weak current that must be amplified with a semi-conductor device to make the ancillary device operate. The main disadvantage in this device rests in the existence of dielectric currents, stemming from the semi-conductor, that cross the device to be started on the one hand and that discharge the battery after a certain storage period on the other. This switch lacks reliability and does not make it possible to store signalling buoys, mines outfitted with the latter, etc., for a sufficiently long period.

The purpose of this invention is to provide an electric feed device which overcomes the previously mentioned disadvantages by providing a device which can start as soon as it is immersed in a liquid, in which there is no dielectric current and the operation of which is interrupted upon the disappearance of the immersion liquid.

SUMMARY OF THE INVENTION

The invention comprises an electric feed device which can be started by immersion in a liquid by way of two electrodes, wherein an initial control circuit, which includes two electrodes in series, an initial voltage source and the coil of an initial relay control a second circuit, which includes a second voltage source, a second relay and the contact of the initial relay, that is connected to use terminals for an external load, the feed voltage at the use terminals being equal to the sum of the source voltages.

A device according to the invention can include a sealed case which encloses both circuits and displays an outwardly open cavity, at the bottom of which both electrodes are placed.

The electrodes can be comprised of conductive parts of which the surface area and spacing are defined by the ratio:

$$Vo = \left(1 - \frac{1}{1 + \frac{R'\sigma s}{L}}\right) \times Uo$$

wherein: Vo represents the source voltage, L is the distance between the two electrodes, Uo the threshold for triggering the relay, s the surface area of an electrode, R' the coil resistance, and $\sigma$ the conductivity for the electrodes-immersion liquid entity.

The electrodes can be formed of metal screws with an area of about 320 $mm^2$ fastened to the case about 12 mm from one another.

The electrodes can be subjected to surface treatment to improve conductivity.

The electrodes can be separated by an insulating wall with a height greater than that of the electrodes.

The first voltage source can have a voltage that is lower than that of the second voltage source.

The first relay can have a substantial internal resistance of about 300 to 2000 ohms and the second relay a low internal resistance of about 20 to 50 ohms.

A result achieved with the device according to the invention rests in the fact that the operating mode is automatically triggered by the presence of a liquid, even if it has low conductivity, thus ensuring great safety both in the operation of the device which is dependent upon it and when said device does not operate. Improper out of liquid operation is prevented by the relative inaccessability of both electrodes.

Another result is in operation independent of hydrostatic pressure.

Another result provided by the device according to the invention rests in the fact that the batteries do not release current outside of the planned operating periods.

Furthermore, this device makes it possible to test any apparatus dependent upon it prior to use, and it can be protected from unexpected starts outside of its planned use.

BRIEF DESCRIPTION OF THE DRAWINGS

Other advantages of the invention will emerge in the description that follows of an embodiment supplied as an illustration pertaining to the drawings wherein.

DETAILED DESCRIPTION OF THE INVENTION

Figure 1:
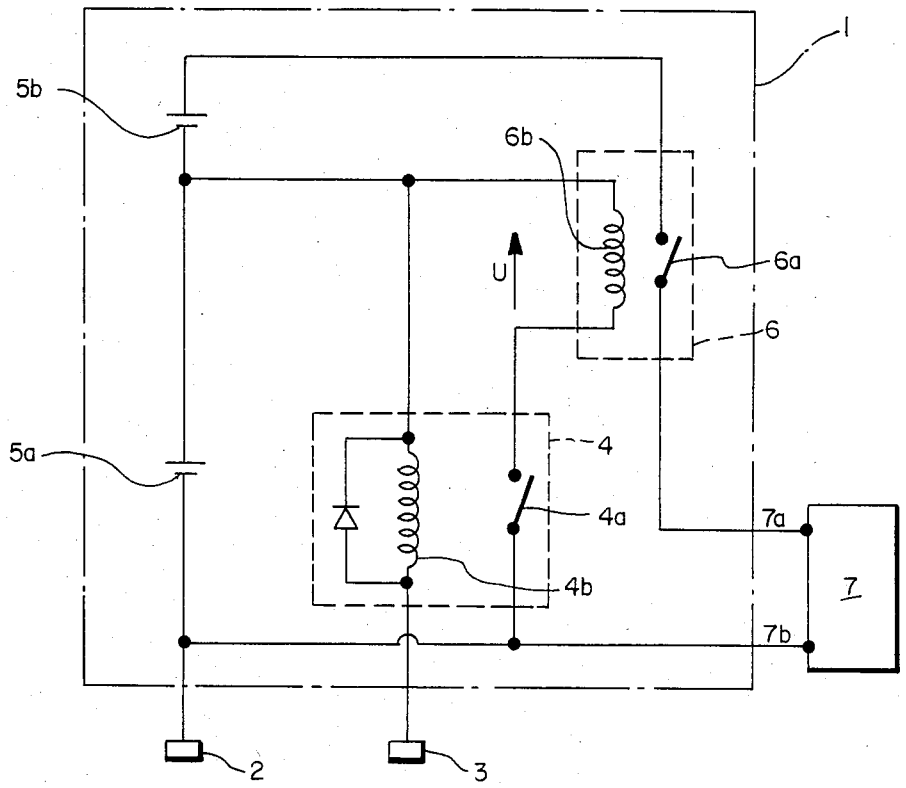
FIG. 1 is a schematic display of a feed device according to the invention.

The feed device displayed in FIG. 1 includes a sealed and closed case 1, which encloses a first circuit which includes in series the electrodes 2 and 3, a voltage source 5*a* and the coil 4*b* of a first relay 4. A second circuit includes in series the switch or contact 4*a* of the first relay 4, a second power relay 6 and a voltage source 5*b*. The relay 6 is branched with output terminals 7*a*, 7*b* to any device 7 to be fed and has a low internal resistance of about 20 to 50 ohms; the relay 6 enables the break of a current of about 10 to 12 A. The relay 4 has a substantial internal resistance of about 300 to 2000 ohms and can have low power, its contact 4*a* having to ensure the break of a current equal to several milliamps (about 20). At rest, or in the absence of a conductive liquid between both electrodes, the difference in potential at the edge of the coil 4*b* of the relay 4 is null; therefore, the contact 4*a* is open and the voltage U is null. The same applies at the relay 6 level.

The operation of the feed device is as follows. When both electrodes are immersed inside a liquid which is even slightly conductive, for instance, sea water, a current is created through the liquid which closes the first circuit that includes the source 5*a* and the coil 4*b*. If the difference between voltage Vo and the voltage drop V between electrodes 2 and 3 is greater than the triggering threshold of relay 4, the contact 4*a* closes and voltage V is equal then to voltage Vo. Therefore, the closing of contact 6*a* of relay 6 is controlled; the load or device 7 is automatically fed and it has all the voltage Vo which is available at the terminals of the sources 5*a* and 5*b*.

Figure 2:
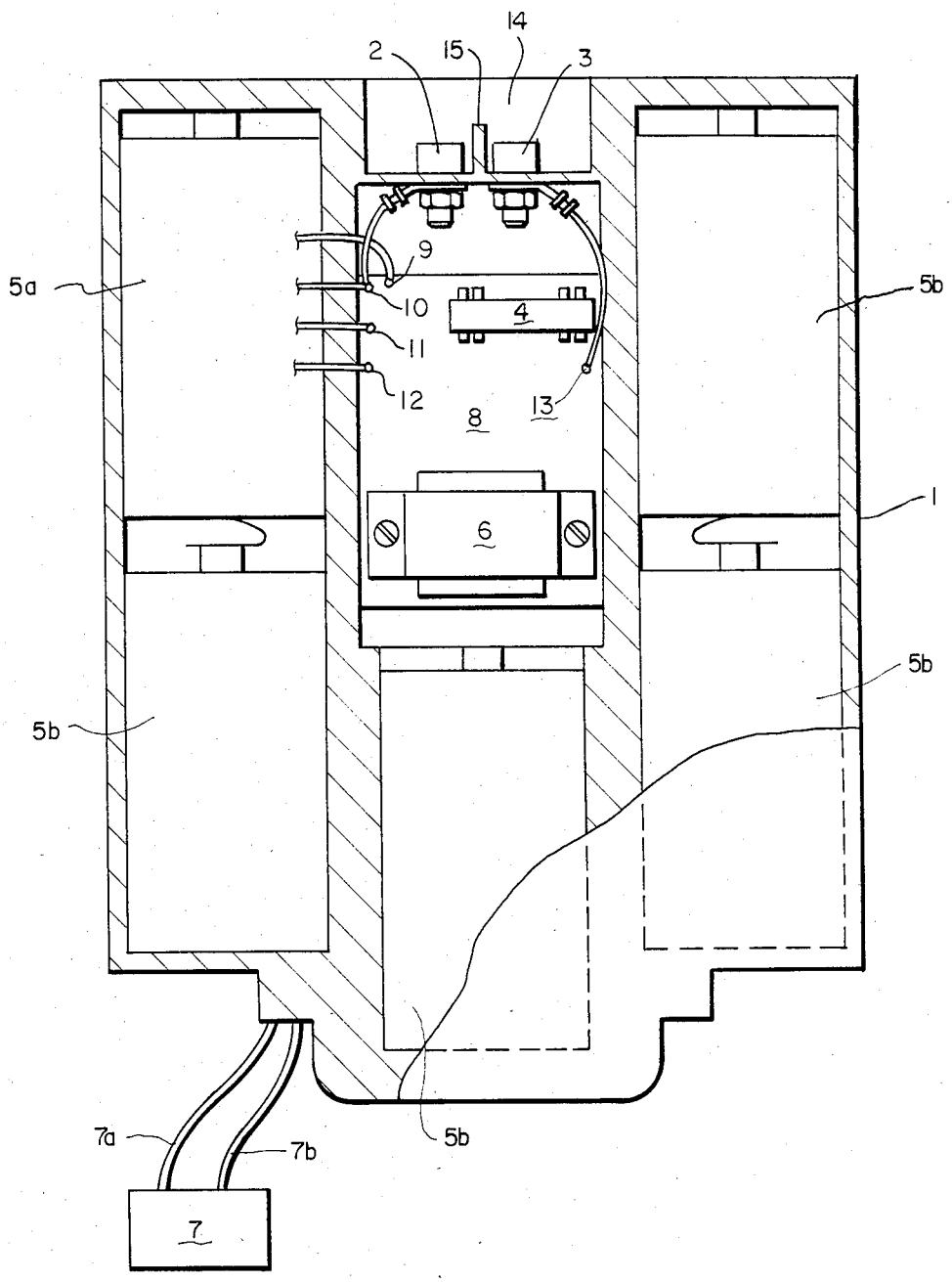
FIG. 2 is a view from above of an embodiment of the invention.

In FIG. 2, an embodiment is shown in which a case 1 encloses 5 batteries of 3 volts each, relays 4 and 6, and a printed circuit 8 which makes it possible to branch the previously mentioned elements with electrodes 2 and 3. The printed circuit 8 includes:

a terminal 10 connected to the negative pole of the group of batteries 5*a*, to the mobile end of contact 4*a* of relay 4, to electrode 2, and to the use terminal 7*b*;

a terminal 11 connected to the positive pole of the group of batteries 5*b* and to the stationary end of contact 6*a* of relay 6;

a terminal 12 connected to the mobile end of contact 6*a* of relay 6 and to the use terminal 7*a*;

a terminal 13 connected to the other terminal of coil 4*b* of the relay 4 and to the electrode 3.

Figure 3:
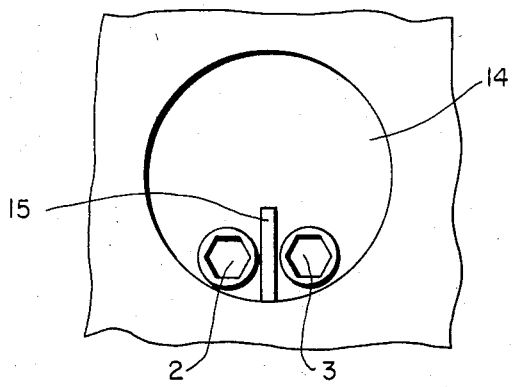
FIG. 3 is a view from above of an embodiment of the electrodes.

The case 1 includes a cavity 14 which is open on the outside and inside of which the electrodes are placed. The latter are separated by an insulating protective partition 15. As shown in FIGS. 2 and 3, the electrodes 2 and 3 are easily made of hexagonal socket screws. The surface of the electrodes is defined so that contact resistance is insignificant in the face of liquid resistance. Referring to a segment of conductive liquid, the:

section (s) is the surface area of each electrode, length (L) is the distance between the 2 electrodes, conductivity ($\sigma$) depends on the nature of the liquid.

Where the liquid-electrode contact resistance can be ignored (by electrode silverplating, for example), an initial approximation of the resistance of this segment may be made as follows:

$$R=L/\sigma s$$

Under these circumstances, if R′ is the resistance of the coil 4*b* of relay 4 and Uo its triggering threshold, the voltage of the group of batteries 5*a* must be such that:

$$Vo=\left(1-\frac{1}{1+\frac{R'\sigma s}{L}}\right)Uo$$

As an illustration, suppose that at an ambient temperature, with Vo=9 V, Uo=3.5 V, =0.75 ohm$^{-1}$ m$^{-1}$, R′=380 ohms, and L=12 mm, one obtains electrodes with areas of 320 mm$^2$. The voltage that is needed to close the circuit is about 3.1 volts. Even when the ambient temperature drops, for instance to −20° C., the voltage Vo remains at an adequate level to close the contact 4*a*. We see that the triggering of the relay from the initial circuit is ensured by a source of low voltage, which makes it possible to use a low performance relay 4. On the other hand, the device 7 can be fed by a high voltage source equal to the sum of voltages from sources 5*a* and 5*b*.

It should be noted that in the absence of a conductor between electrodes 2 and 3, the batteries do not release any current, which is advantageous when the feed device must be stored for a very long time, for instance for 5 to 10 years according to the kind of batteries (especially lithium batteries). The inventors have determined that the storage period is almost equal to the useful life span of the batteries 5.

As is apparent, the technology for electromagnetic relays used in this technical sector provides advantages greater than those of the semi-conductor devices. The combination of both relays 4 and 6 makes it possible to avoid a need for amplification of current and therefore eliminates any dielectric current stemming from the use of semi-conductor amplifiers; the feed device can easily be tested by establishing contact between both electrodes outside of any immersion. To this end, we simply need to fill cavity 14 with a conductive liquid or by inserting a conductive wire between the electrodes. Both relays 4*a* and 6*a* open as soon as the branching of the two electrodes is interrupted. Thus, the feed device according to the invention can be used in combination with a recording or transmitting device to detect the presence of liquids and more generally to outfit signaling buoys, distress buoys, submarine mines, etc.

What is claimed is:

1. An electric device which can be started by immersion in a liquid, comprising:

a first circuit comprising, in series, two electrodes, a first voltage source and a first relay coil controlling a first relay switch;

a second circuit comprising, in series, said first voltage source, a second voltage source, a second relay switch controlled by a second relay coil, and use terminals for connection to an external load, the voltage across said use terminals being substantially equal to the sum of the voltages across said first and second voltage sources; and said first relay switch and said second relay coil being connected in series to a voltage source selected from the group consisting of said first voltage source, said second voltage source and a third voltage source.

2. An electric device according to claim 1, further comprising a sealed case enclosing said first and second circuits and having an outwardly open cavity formed on an external surface thereof, said two electrodes being disposed in said cavity.

3. An electric device according to claim 2, wherein the surface area of and spacing between said electrodes satisfies the relationship:

$$Vo=\left(1-\frac{1}{1+\frac{R'\sigma s}{L}}\right)Uo$$

wherein:

Vo=voltage across said first voltage source;

Uo=triggering threshold voltage of said first relay;

R′=resistance of said first relay coil;

$\sigma$=conductivity of the electrodes-immersion liquid combination;

s=surface area of each said electrode;

L=distance between said electrodes.

4. An electric device according to claim 2, wherein said electrodes comprise metal screws fastened to said sealed case, said screws each having a surface area of about 320 mm$^2$ and being spaced about 12 mm from one another.

5. An electric device according to claim 2, further comprising an insulating wall disposed between and with a height greater than that of said electrodes.

6. An electric device according to claim 1, wherein each of said electrodes further comprises a surface treated to improve conductivity.

7. An electric device according to claim 1, wherein the voltage across said first voltage source is lower than that across said second voltage source.

8. An electric device according to claim 7, wherein said first relay has an internal resistance of about 300 to 2000 ohms and said second relay has an internal resistance of about 20 to 50 ohms.

9. An electric device according to claim 1 which comprises a submersible buoy.

10. An electric device according to claim 1 which comprises apparatus for detecting the presence of a liquid.

* * * * *